United States Patent [19]

Brooker

[11] Patent Number: 4,703,560

[45] Date of Patent: Nov. 3, 1987

[54] LOCKING KNIFE APPARATUS

[75] Inventor: Dennis B. Brooker, Prole, Iowa

[73] Assignee: Hawks Edge, Inc., Des Moines, Iowa

[21] Appl. No.: 837,384

[22] Filed: Mar. 7, 1986

[51] Int. Cl.[4] ..... B26B 1/04

[52] U.S. Cl. ..... 30/155; 30/154; 30/161

[58] Field of Search ..... 30/154, 155, 161

[56] References Cited

U.S. PATENT DOCUMENTS

| | | | |
|---|---|---|---|
| D. 257,612 | 12/1980 | Goldin et al. | D8/99 |
| D. 257,943 | 1/1981 | Finlay | D8/95 |
| D. 265,719 | 8/1982 | Dowdy | D8/99 |
| 1,372,579 | 3/1921 | Weishaupt | 30/155 |
| 4,233,737 | 11/1980 | Poehlmann | 30/335 |
| 4,272,887 | 6/1981 | Poehlmann | 30/161 |
| 4,466,561 | 8/1984 | Slaughter | 30/155 X |

FOREIGN PATENT DOCUMENTS

| | | | |
|---|---|---|---|
| 3324637 | 2/1984 | Fed. Rep. of Germany | 30/161 |
| 328689 | 1/1903 | France | 30/161 |
| 16328 | of 1912 | United Kingdom . | |

OTHER PUBLICATIONS

Exhibit A—Entitled D. Brooker Cutlery & Engraving Showing Prior Art Knives, (small booklet, 4 pages).

Exhibit B—1 Sheet, Showing Prior Art Knife Partially Disassembled.

Exhibit C—1 Sheet, Showing Prior Art Knife Completely Disassembled.

Puma Knives Catalog, First Page, Knife 16-715 at center of page.

*Primary Examiner*—E. R. Kazenske

*Assistant Examiner*—Michael D. Folkerts

*Attorney, Agent, or Firm*—Henderson & Sturm

[57] ABSTRACT

A locking knife apparatus that includes a handle unit, a blade member support unit, a blade member, and a blade pivot hole and lock unit. The blade member includes a pivot slot disposed therethrough for operable interaction with the blade pivot hole and lock unit. Both the blade member and the blade member support unit include tabs and notches that may interact with one another to assist in locking the blade member in an open position.

2 Claims, 11 Drawing Figures

LOCKING KNIFE APPARATUS

TECHNICAL FIELD

This invention relates generally to knives, and more particularly to folding knives.

BACKGROUND ART

Many knives and related cutting and stabbing implements are known in the prior art. Many of these knives include a handle unit and a blade that pivots within the handle unit such that the blade may be folded away within the handle when not in use and may be folded into an open position during use. When folded, such a knife may be conveniently and safely carried in a pocket, backpack or any other convenient location. When opened, however, such a knife may not be safe to use. For instance, the blade of such a knife can close while being used, and injure the user.

In an effort to alleviate this problem, at least one prior art folding knife includes a spring biased locking member that interacts with the blade to lock the blade into an open position. While this arrangement will offset problems noted above, the improvement is costly to implement and may further be subject to wear and subsequent failure.

Other knives are non-folding. Although such a knife may be used without fear of the blade folding back on the user, an exposed blade poses difficulties during periods of non-usage. Typically, such a knife must either be stored within a sheath or within some other container that will protect the blade from harm and that will protect the user from the blade.

There exists a need for a locking knife apparatus that combines the convenience and safety of a folding knife with the safety during use features of a non-folding knife.

DISCLOSUE OF THE INVENTION

These needs are met by the provision of the invention disclosed herein. This invention comprises a locking knife apparatus comprised generally of a handle unit, a blade member support unit, a blade member and a blade pivot hole and lock unit.

The handle unit may be comprised of two substantially identical handle members. The handle unit may further include an opening disposed at least partially therethrough for receiving a blade pivot hole and lock unit.

The blade member support unit may be comprised of a substantially longitudinal member having an upper surface for supporting the blade member when in the closed position, and a blade member support lock notched unit and a blade member support lock tab unit formed thereon for locking interaction with the blade member. The blade member support unit may be affixed between the handle members.

The blade member includes a blade having a base. The base includes a blade member lock notched unit and a blade member lock tab unit. In addition, the base of the blade member includes a pivot slot formed therethrough.

The blade pivot hole and lock unit may be comprised of a threaded bolt having a head with a hole disposed radially therethrough. A ring may be disposed through this hole to facilitate ease of operation.

The blade member may then be disposed within the handle unit such that the opening formed by the pivot slot in the blade member base coincides with the opening through the handle unit. The threaded portion of the blade pivot hole and lock unit may then be threadably disposed through the handle unit opening, thereby passing through the blade member pivot slot as well.

Upon straightening the pivot hole and lock unit, the blade member may be securely locked in place with the blade positioned inside the handle unit. By slightly unthreading the blade pivot hole and lock unit, the blade member may be pivoted about the pivot hole and lock unit. In addition to the pivoting movement, the blade member may translate somewhat about the blade pivot hole and lock unit as per the track formed by the pivot slot. A blade member may then be positioned such that the blade member lock tab unit fits snugly within the blade member support lock notched unit, and so that the blade member support lock tab unit fits snugly within the blade member lock notched unit. So positioned, the blade pivot hole and lock unit may again be straightened to lock the blade member into the fully opened position.

To close the knife, the above procedure need only be reversed. By use of this locking knife apparatus, the operator may conveniently store and transport the knife from place to place with the convenience of a standard folding knife. When in use, however, the blade member may be locked to the open position, thereby affording the safety and convenience of a non-folding knife.

BRIEF DESCRIPTION OF THE DRAWINGS

These and other attributes of the invention will become more clear upon a through study and review of the following of the Best Mode for Carrying Out the Invention, particularly when such study and review is made with reference to the drawings, wherein.

BEST MODE FOR CARRYING OUT THE INVENTION

Figure 8:
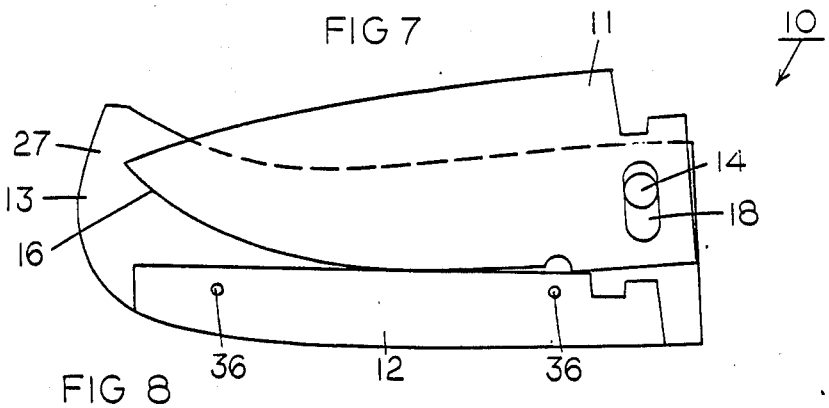
FIG. 8 is a diagramatic representation of the apparatus with one handle member removed and with the blade member depicted in a fully closed position.

Referring now to the drawings, and in particular to FIG. 8, the apparatus as seen generally is denoted by the numeral 10. The apparatus (10) includes generally a blade member (11), a blade member support unit (12), a handle unit (13) and a blade pivot hole and lock unit (14). These general members will now be described in more detail in seriatim fashion.

The blade member (11) includes a generally longitudinal member having a blade surface (16) formed thereon. One end (17) of the blade member (11) comprises the base of the blade member.

This base (17) includes an elongate pivot slot (18) formed laterally therethrough. In addition, the base also includes a blade member lock notched unit (19) and a blade member lock tab unit (21) formed thereon. The purpose and use of these elements will be made more clear below.

The blade member support unit (12) may be comprised of a substantially longitudinal member having an upper surface (22) suitable for supporting the blade member (16) in the closed position as disclosed below. The blade member support unit (12) includes at one end a blade member support lock notched unit (23) and a blade member support lock tab unit (24) disposed thereon. Finally, the blade member support unit (12) includes two small holes (26) that may be utilized to affix the blade member support unit (12) to the handle unit (13).

The handle unit (13) may be comprised of two handle members. Since both handle members are substantially identical, only one is described here in detail.

The handle member (27) may be comprised of a substantially longitudinal member of sufficient width to enclose and protect the blade surface (16) of the blade member (11) when in the closed position as described below. The handle member (27) also includes a threaded opening (28) disposed therethrough, the purpose of which will be described in more detail below. Finally, the handle member (27) includes two small openings (29) for use in securing the blade member support unit (12) to the handle member (27).

Figure 1:
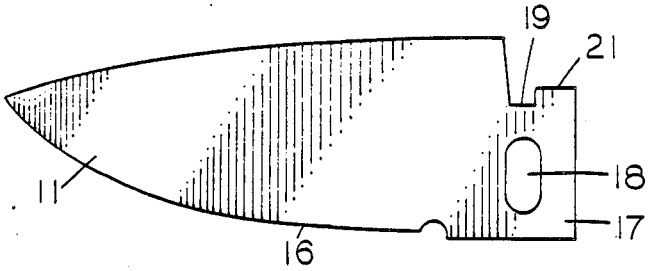
FIG. 1 is a front elevational view of the blade member.
Figure 2:
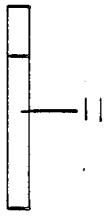
FIG. 2 is a side elevational view of the blade member.
Figure 3:
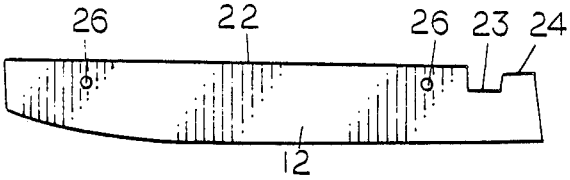
FIG. 3 is a front elevational view of the blade member support unit.
Figure 4:
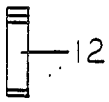
FIG. 4 is a side elevational view of the blade member support unit.
Figure 6:
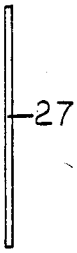
FIG. 6 is a side elevational view of a handle member.
Figure 5:
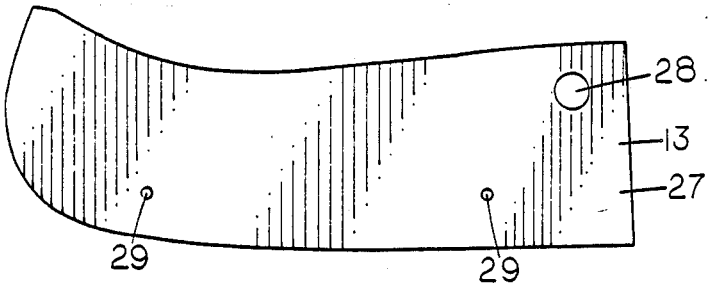
FIG. 5 is a front elevational view of a handle member.
Figure 7:
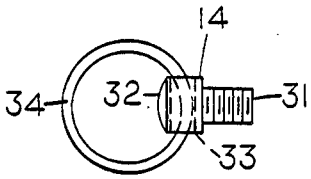
FIG. 7 is a front elevational view of a blade pivot hold and lock unit.

With reference to FIG. 7, the blade pivot hole and lock unit (14) may be comprised of a threaded bolt member (31) having a head (32) with a hole (33) disposed radially therethrough. A ring (34) may be disposed through this hole.

Referring now to FIG. 8, the apparatus (10) may be seen with one handle member (27) removed to expose the blade member support unit (12) in the blade member (11). It will be appreciated that the blade member support unit (12) may be secured to the handle member (27) by disposing two small screws (36) through the holes provided therefor in the blade member support unit (12) and in the handle member (27). Furthermore, the threaded member (31) of the blade pivot hole and lock unit (14) may be threadably disposed through the hole (28) provided therefor in the handle member (27).

Figure 9:
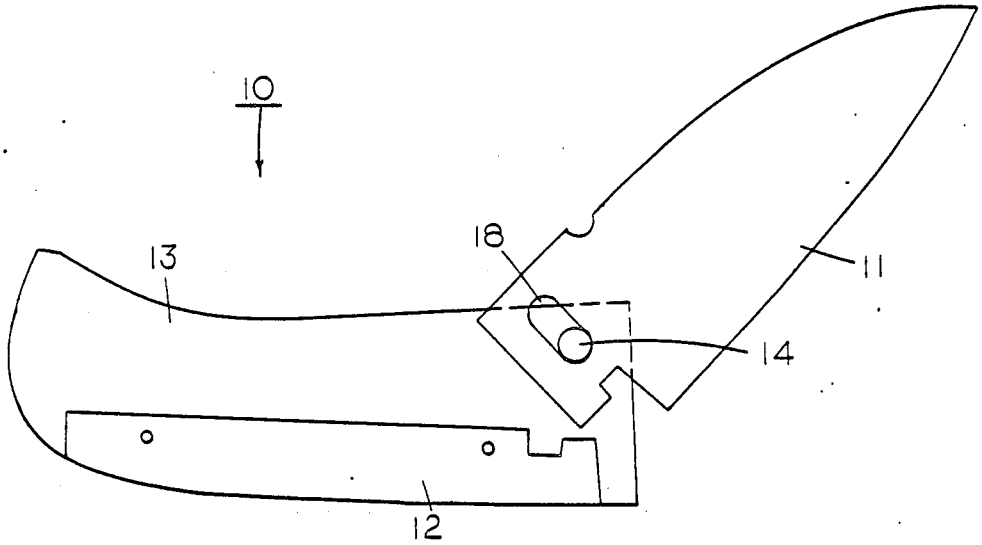
FIG. 9 is a front elevational diagramatic view of the apparatus with one handle member removed and with the blade member depicted in a pivoting position.

The blade member (11) may be disposed within the handle unit (13) such that the blade surface (16) rests upon the blade member support unit (12) and such that the pivot slot (18) becomes disposed about the blade pivot hole and lock unit (14). With the remaining handle member (not shown) attached to the apparatus (10), it will be appreciated that the blade member (11) may be locked in a closed position by tightening the blade pivot hole and lock unit (14). Similarly, it will be appreciated that the blade member (11) may be pivoted about the blade pivot hole and lock unit (14) as depicted in FIG. 9 by first loosening somewhat the blade pivot hole and lock unit (14).

It should be noted that during this pivoting movement, the blade member (11) may translate with respect to the blade pivot hole and lock unit (14) along the track provided by the pivot slot (18). For the configuration shown, the blade member (11) could not pivot to a fully open position as depicted in FIG. 10 without such translation.

Figure 10:
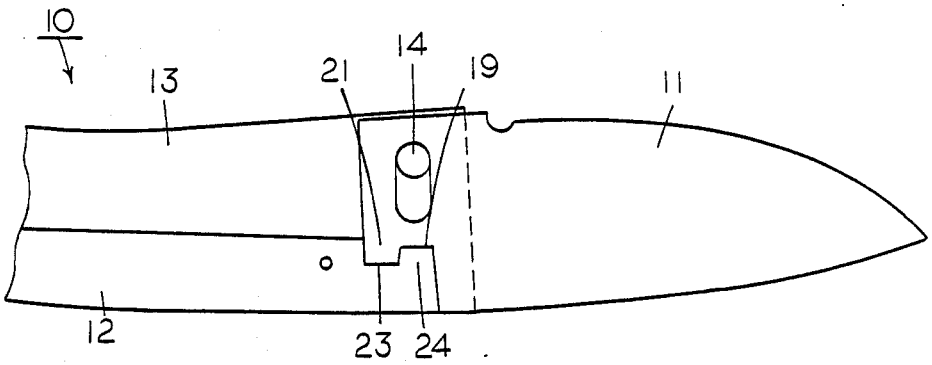
FIG. 10 is a front elevational diagramatic view of the apparatus with one handle member removed and with the blade member depicted in a fully open position.

With continued reference to FIG. 10, it may be seen that the blade member lock notched unit (19) cooperates with the blade member support lock tab unit (24), and the blade member lock tab unit (21) cooperates with the blade member support lock notched unit (23) to rigidly hold the blade member (11) in place with respect to the remainder of the apparatus (10). The blade pivot hole and lock unit (14) may then be retightened to prevent the blade member (11) from being displaced from this position.

Figure 11:
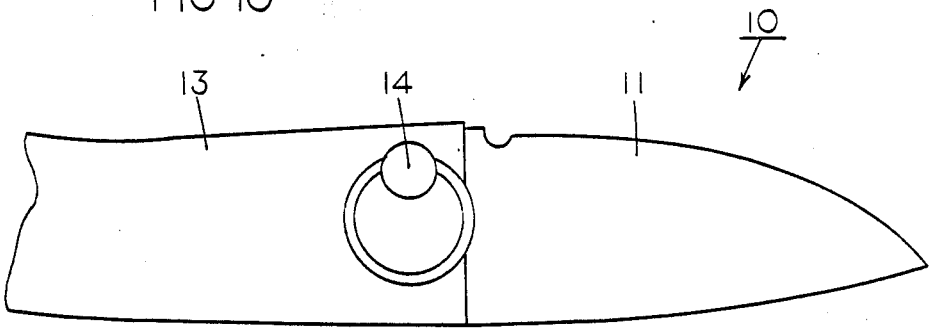
FIG. 11 is a front elevational view of the apparatus blade member in a fully open position.

As depicted in FIG. 11, the apparatus (10) may now be used without concern that the blade member (11) will pivot back towards the closed position. When desired, the blade member (11) may be returned to the fully closed position as depicted in FIG. 8 by simply reversing the above steps.

The apparatus (10) may be comprised of steel or any other suitable material. Obviously, many modifications and variations of the present invention are possible in light of the above teachings. It is therefore to be understood that, within the scope of the appended claims, the invention may be practiced otherwise than as specifically described.

I claim:

1. Apparatus comprising:

a first handle member having a fist portion and a second portion;

a second handle member having a first portion and a second portion;

a rigid blade support disposed between the second portions of said fist and second handle members, and extending across the major portion of the length of said first and second handle members;

means for holding said rigid blade support from movement with respect to said first and second handle members;

an elongated blade having a longitudinal centerline, at least one working edge and an opposite edge on the other side of said blade, one end of said blade having a slot disposed therethrough, said slot being longer along its longitudinal axis than in its width, said longitudinal axis of the slot being generally transversely disposed with respect to the longitudinal centerline of the elongated blade, said slot having one end and an other end;

a threaded fastener means extending though one end of the first portions of said first and second handle members and through said slot in the blade for attachment to said first and second handle members;

said blade being movable between a first position wherein said working edge is disposed between said first and second handle members and in abutment with said rigid blade support, the edge opposite from said working edge extending out from between the first portions of said first and second handle members and said threaded fastener means being in said one end of said slot when said blade is in the first position thereof, and a second position of said blade, disposed 180 degrees from said first position thereof, wherein substantially all of said blade, including said working edge thereof, is extending out from betwen said first and second handle members and said threaded fastener means is in said other end of said slot; and stop means for selectively preventing said blade from rotating when said blade is in the second position thereof, said stop means comprising:

a projection of one of (a) said one end of said opposite edge of the blade and (b) one end of said rigid blade support; and notch means for receiving said projection on the other one of (a) said one end of said opposite edge of the blade and (b) said one end of said rigid blade support.

2. The apparatus of claim 1 wherein said projection is on said blade and said notch means is one end of said rigid blade support.

* * * * *